US005342101A

United States Patent [19]

Shih

[11] Patent Number: 5,342,101

[45] Date of Patent: Aug. 30, 1994

[54] LOCK LATCH

[76] Inventor: Nan C. Shih, 116, Changtsao Rd., Changhua City, Taiwan, 500

[21] Appl. No.: 74,609

[22] Filed: Jun. 11, 1993

[51] Int. Cl.[5] ..... E05C 1/12

[52] U.S. Cl. ..... 292/165; 292/337

[58] Field of Search ..... 292/165, 173, 337, DIG. 65

[56] References Cited

U.S. PATENT DOCUMENTS

| | | | |
|---|---|---|---|
| 2,533,582 | 12/1950 | Hillgren | 272/337 |
| 2,634,151 | 4/1953 | Russell et al. | 292/337 |
| 2,759,751 | 8/1956 | Kaiser | 292/337 |
| 2,795,447 | 6/1957 | Schlage | 292/337 X |
| 3,036,850 | 5/1962 | Schmid | 292/337 X |
| 4,564,229 | 1/1986 | Mullich et al. | 292/337 X |
| 4,602,490 | 7/1986 | Glass et al. | 292/337 X |
| 4,711,477 | 12/1987 | Fann et al. | 292/337 X |

*Primary Examiner*—Rodney M. Lindsey

*Attorney, Agent, or Firm*—Jacobson, Price, Holman & Stern

[57] ABSTRACT

A door latch has an actuating mechanism which retracts the latch tongue by a small amount of rotation of a doorknob. The actuating mechanism includes a wheel rotated by the knob which has a projecting tooth engaging a lever that pulls a plate connected to the latch arm. The lever arm is longer than the tooth.

4 Claims, 2 Drawing Sheets

LOCK LATCH

BACKGROUND OF THE INVENTION

The present invention relates to a fastening means for a lock, and more particularly to a latch for a door lock.

In general, the mechanism of unlocking a conventional door lock of the prior art involves a withdrawing motion of a lock tongue of the lock latch. Such a withdrawing motion of the lock tongue is attained by rotating the door knob for at least 45 degrees or more. It is often inconvenient or even impossible for a physically handicapped person to turn the door knob for 45 degrees or more in order to unlock the door lock. In order to relieve the physically handicapped person of such a hardship, some of the public buildings or the private homes have doors with a lever in place of a knob. It is conceivable that a lever on a door can be pressed more easily to release the latch with an elbow of the physically handicapped person. However, the door lever must still be turned for at least 45 degrees so as to release the latch.

SUMMARY OF THE INVENTION

The object of the present invention is to provide a door lock latch with a lock tongue which can be so moved as to release the latch by a small rotation of the doorknob.

In keeping with the principles of the present invention, the foregoing object of the present invention is attained by a lock latch, which comprises a front housing, a rear housing, a lock tongue, an actuating member, and a cover. The front housing and the rear housing are provided respectively with axial holes for locating an actuating shaft and a pulling wheel which has a tooth and a long arm. The actuating shaft activates an actuating wheel to press on the tooth of the pulling wheel so as to cause the long arm of the pulling wheel to be retained in a retaining hole of an actuating plate, which is then pulled indirectly by the pulling wheel to cause the lock tongue to be pulled to release the latch.

The foregoing object and the features of the present invention will be more readily understood upon a thoughtful deliberation of the following detailed description of the preferred embodiment of the present invention in conjunction with the accompanying drawings.

DETAILED DESCRIPTION OF THE INVENTION

Figure 1:
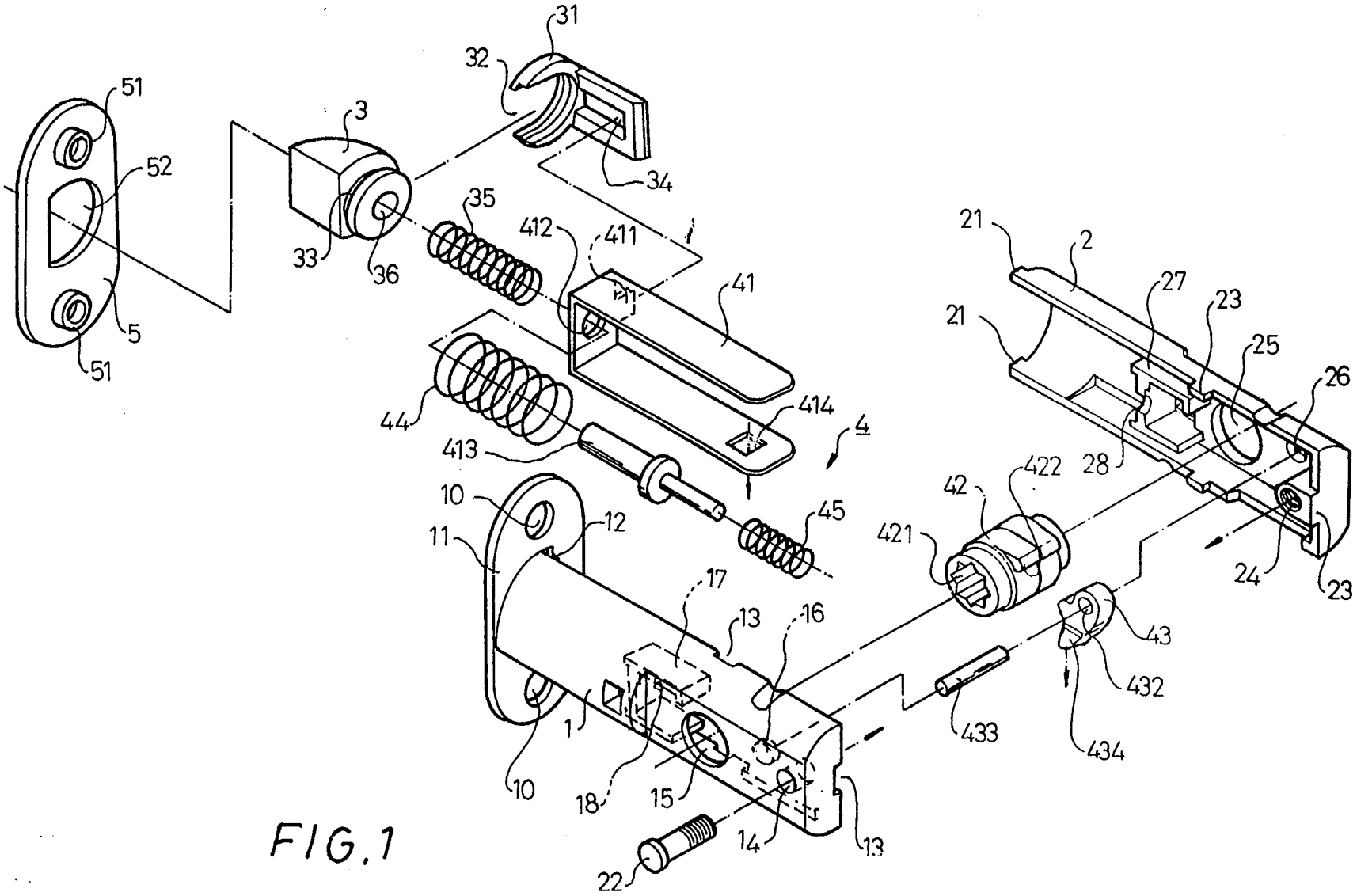
FIG. 1 shows an exploded view of the present invention.

Referring to FIG. 1, a lock latch of the present invention is shown comprising a front housing 1, a rear housing 2, a lock or latch tongue 3, an actuating member 4, and a cover 5.

The front housing 1 and the rear housing 2 are joined together to form an elongate latch housing. The front housing 1 is provided with a face plate 11 having mortises 12 dimensioned to receive therein securely tenons 21 of the rear housing 2. In addition, the front housing 1 and the rear housing 2 are joined together securely by means of a slot 13 of the front housing 1, which is so dimensioned as to retain therein securely a connection block 23 of the rear housing 2. Furthermore, the front housing 1 and the rear housing 2 are further fastened securely by means of a bolt 22 which engages a threaded hole 14 of the front housing 1 and a threaded hole 24 of the rear housing 2. The face plate 11 of the front housing I has two insertion holes 10, each of which is dimensioned to receive therein securely a round projection 51 of the cover 5.

The front housing 1 and the rear housing 2 are joined together to form therein a receiving space in which the lock tongue 3 and the actuating member 4 are disposed. The front housing 1 is provided with an axial hole 15 corresponding in location to an axial hole 25 of the rear housing 2. An actuating wheel 42 is rotatably mounted at both ends thereof in the axial holes 15 and 25. Received in a shaft hole 16 of the front housing 1 and a shaft hole 26 of the rear housing 2 is a shaft 433 on which a pulling wheel 43 is rotatably mounted. The front housing 1 is further provided with a rail 17 corresponding in location to a rail 27 of the rear housing 2. The rails 17 and 27 are intended for use in guiding an actuating plate 41 to move in a linear manner.

The lock tongue 3 can be made integrally or separately, depending on the manufacturing requirements. The lock tongue 3 is united with an extension body 31 by means of a mortise 32 of the extension body 31 and a tenon 33 of the lock tongue 3. The extension body 31 is provided with a slot 34 dimensioned to retain therein a protruded portion 411 of the actuating plate 41. As long as the protruded portion 411 remains stationary, there is a space for the lock tongue 3 to withdraw at the time when the lock tongue 3 is exerted on by a pressure. The lock tongue 3 is provided with a blind hole 36 in which one end of an elastic element 35 is received. The elastic element 35 has another end that urges the actuating plate 41. As a result, the lock tongue 3 can be caused by the elastic element 35 to regain its original position.

The actuating member 4 comprises an actuating plate 41, an actuating wheel 42, and a pulling wheel or lever 43. The actuating wheel 42 is rotatably mounted in the axial holes 15 and 25 of the front and the rear housings I and 2. The actuating wheel 42 is made up of two members similar in shape to each other and is provided with an axial hole 421 so dimensioned as to permit an actuating shaft of an inner knob or an outer knob of the lock to pass therethrough. The actuating wheel 42 is further provided with a tooth 422 capable of exerting a pressure on a projection or tooth 431 of the pulling wheel 43 at the time when the actuating shaft of the inner knob or the outer knob is so turned as to cause the actuating wheel 42 to rotate. The pulling wheel 43 is mounted on a shaft 433 by means of an axial hole 432. The shaft 433 is received at both ends thereof in the shaft holes 16 and 26 of the front and the rear housings 1 and 2. The pulling wheel or lever 43 has a lever arm 434 so dimensioned as to fit into a retaining hole 414 of the actuating plate 41. When the actuating wheel 42 is caused to turn, the actuating plate 41 is pulled indirectly by the pulling wheel 43 to retreat. When the protruded portion 411 of the actuating plate 41 is retained in the slot 34 of the extension body 31, the actuating plate 41 can pull the lock tongue 3 to withdraw. The actuating plate 41 is provided with a pin hole 412 dimensioned to permit a locating pin 413 to pass therethrough. The locating pin 413 has a flange located at a midpoint thereof and one end which is fitted into an elastic element 45 and which urges a connecting wall located between the rails 17 and 27. The elastic element 45 has one end urging the flange of the locating pin 413 and is fitted into another elastic element 44. The locating pin 413 has another end which is fitted into an elastic element 35 and which urges the blind hole 36 of the lock tongue 3. One end of the locating pin 413 can be caused to pass through one of the two holes 18 and 28 disposed in the connecting wall. The elastic element 44 has one end urging the actuating plate 41 and another end urging the connecting wall located between the rails 17 and 27.

The cover 5 has two round projections 51 which are corresponding in location to two locating holes 10 of the face plate 11 of the front housing I and which are dimensioned to fit securely into the two locating holes 10 of the face plate 11 of the front housing 1. The cover 5 is further provided with a restricting hole 52 which has a cross-sectional shape similar to that of the lock tongue 3 and which has a size similar to that of the non-circular portion of the lock tongue 3. As a result, only the non-circular portion of the lock tongue 3 is permitted to pass through the restricting hole 52 of the cover 5, with the rest of the lock tongue 3 being kept inside the receiving space formed by the front and the rear housings 1 and 2.

Figure 2:
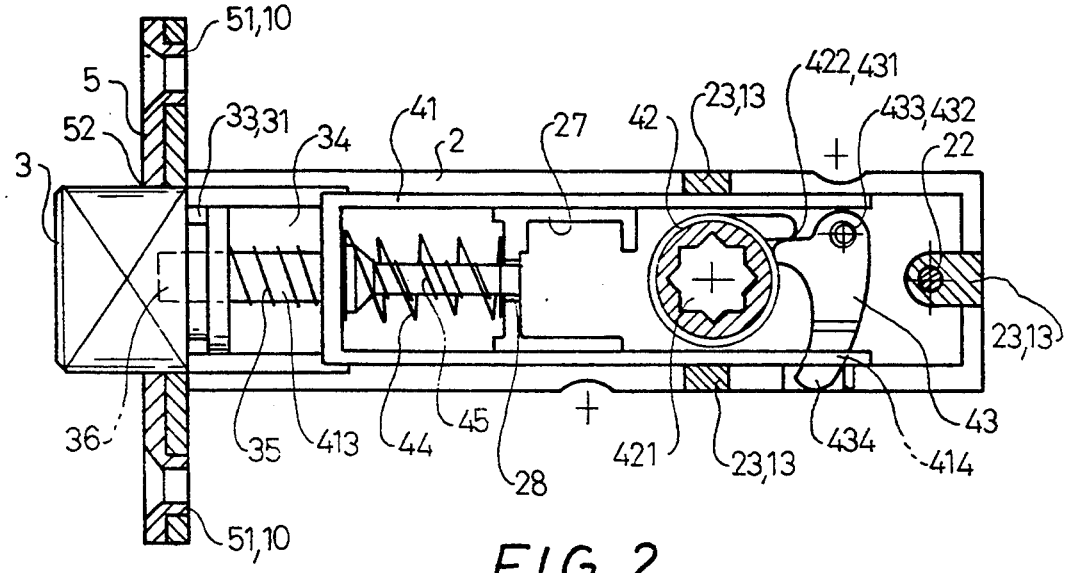
FIG. 2 shows a sectional view of the present invention in combination.
Figure 3:
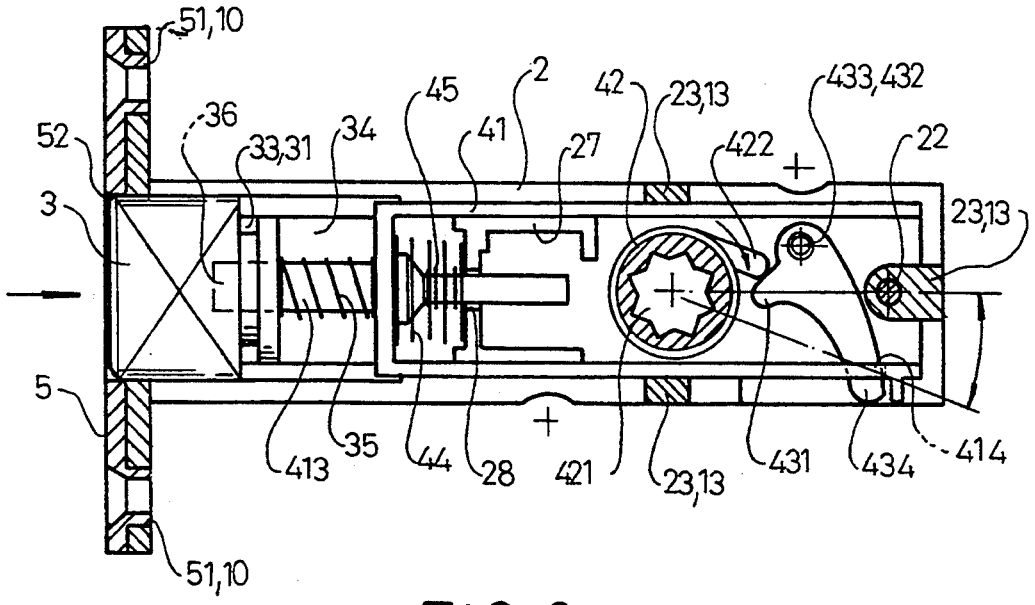
FIG. 3 shows a schematic view illustrating the motion of the present invention as shown in FIG. 2.

As shown in FIG. 2, the actuating plate 41 and the lock tongue 3 are urged respectively by the elastic elements 35, 44 and 45 at the time when the actuating wheel 42 is not caused to turn. As a result, the non-circular portion of the lock tongue 3 is permitted to pass through the restricting hole 52 of the cover 5. When the actuating wheel 42 is caused to turn in a clockwise direction by a door knob or a door lever, as shown in FIG. 3, the actuating wheel 42 triggers the pulling wheel 43 to exert indirectly a tension on the actuating plate 41, thereby causing the actuating plate 41 to retreat, or move rightwards as shown in FIG. 3. As a result, the lock tongue 3 is pulled by the actuating plate 41 so as to move into the receiving space formed by the front and the rear housings 1 and 2. As soon as the actuating wheel 42 is relieved of a force causing the actuating wheel 42 to turn, the lock tongue 3 and the actuating plate 41 are caused by the elastic elements 35, 44 and 45 to regain their original positions as shown in FIG. 2. In the meantime, the actuating wheel 42 regains its original position by means of a retrieving element of the lock.

It must be noted here that the lock tongue 3 of the present invention can be caused to move inwards by a slight rotating action of the actuating wheel 42, in view of the fact that the actuating wheel 42 can trigger the pulling wheel 43 to exert indirectly a tension on the actuating plate 41. Therefore, the lock latch of the present invention is suitable for use in a door, which can be unlocked easily by a person in general and by a physically handicapped person in particular.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A door latch assembly comprising an elongate latch housing having one end with a face plate, a latch tongue in said housing, spring means in the housing urging the latch tongue to project from said one end of the housing, an actuating mechanism in said housing for withdrawing the latch tongue into the housing against the force of the spring means, the actuating mechanism including an actuating plate, connector means between the plate and the latch tongue, an actuator wheel rotatably mounted in said housing about a doorknob axis perpendicular to a longitudinal axis of the housing, means on said actuator wheel for attaching a doorknob to rotate the actuator wheel about the doorknob axis, a projecting tooth formed on said actuator wheel, and a pulling lever pivotally mounted in said housing on a pivot axis parallel to said doorknob axis, said pulling lever having a projection to be engaged by said tooth when the actuator wheel is rotated in one direction, said lever further having a lever arm longer than said tooth engaging in an aperture in the actuating plate so that rotation of the actuator wheel in said one direction from a rest position provides pivotal motion of the lever through engagement of said tooth and said projection effective to cause said lever arm to move the actuating plate lengthwise in the housing and withdrawn the latch tongue into the housing against the force of the spring means, and so that release of the actuator wheel enables the spring means to return the actuator plate and latch tongue, the lever and the actuator wheel to the rest position.

2. An assembly as claimed in claim 1 wherein the pulling lever is located between the actuator wheel and a second end of the housing opposite said one end and wherein said projection on the lever is located between said pivot axis and said aperture in the acutating plate.

3. An assembly as claimed in claim 1 wherein said connector means between the pulling plate and the latch tongue includes an extension body attached to the latch tongue, a slot in said extension body, a protrusion on the pulling plate engaged in said slot to provide a lost motion connection between the latch tongue and the pulling plate and further spring means between the pulling plate and said latch tongue urging the latch tongue away from the pulling plate and whereby said lost motion connection enables the latch tongue to be pressed into the housing against the further spring means without causing movement of the pulling plate.

4. An assembly as claimed in claim 1 wherein said latch housing comprises front and back housings interconnected substantially along the longitudinal axis of the latch housing.

* * * * *